US007958664B2

(12) United States Patent
An

(10) Patent No.: US 7,958,664 B2
(45) Date of Patent: Jun. 14, 2011

(54) AUTOMATIC STRIATED GUN BARREL CLEANER

(75) Inventor: Sang Jin An, Ulsan (KR)

(73) Assignee: Soosung Machinery Co., Ltd., Ulsan (KR)

( * ) Notice: Subject to any disclaimer, the term of this patent is extended or adjusted under 35 U.S.C. 154(b) by 823 days.

(21) Appl. No.: 11/903,422

(22) Filed: Sep. 21, 2007

(65) Prior Publication Data

US 2008/0229644 A1 Sep. 25, 2008

(30) Foreign Application Priority Data

Feb. 15, 2007 (KR) ..... 10-2007-0015924

(51) Int. Cl.
*F41A 29/00* (2006.01)

(52) U.S. Cl. ..... 42/95; 15/104.05; 15/104.09; 15/106; 15/164

(58) Field of Classification Search ... 42/95; 15/104.05, 15/104.09, 106, 164
See application file for complete search history.

(56) References Cited

U.S. PATENT DOCUMENTS 3,037,228 A * 6/1962 Cummings ..... 15/104.095
3,134,202 A * 5/1964 Hoefler ..... 451/211
3,602,935 A * 9/1971 McDonnell et al. ..... 15/104.09
4,290,163 A * 9/1981 Opitz et al. ..... 15/104.09
4,369,071 A * 1/1983 Flach et al. ..... 134/8
4,468,834 A * 9/1984 David ..... 15/246
4,499,625 A * 2/1985 Bottomley ..... 15/104.165
4,600,444 A * 7/1986 Miner ..... 134/8
4,698,932 A * 10/1987 Schneider ..... 42/95
4,726,137 A * 2/1988 Zurek et al. ..... 42/95
4,901,465 A * 2/1990 Hsu ..... 42/95
4,930,240 A * 6/1990 Bice ..... 42/95
5,099,537 A * 3/1992 Denny ..... 15/88
5,233,791 A * 8/1993 McQueen, Jr. ..... 451/481
5,460,563 A * 10/1995 McQueen, Jr. ..... 451/57
7,005,012 B2 * 2/2006 Bourrelly et al. ..... 134/8
7,073,286 B2 * 7/2006 Paananen et al. ..... 42/95
7,360,271 B2 * 4/2008 Nordstrom et al. ..... 15/246
7,367,151 B1 * 5/2008 Black et al. ..... 42/95
7,520,082 B2 * 4/2009 An ..... 42/95
2007/0051027 A1 * 3/2007 Stordal ..... 42/95
2007/0051028 A1 * 3/2007 Stordal ..... 42/95
2007/0240353 A1 * 10/2007 An ..... 42/95
2007/0240561 A1 * 10/2007 An ..... 89/1.4
2007/0261288 A1 * 11/2007 Perry et al. ..... 42/95
2008/0016747 A1 * 1/2008 Binek et al. ..... 42/95

* cited by examiner

*Primary Examiner* — Bret Hayes
*Assistant Examiner* — Michael D David
(74) *Attorney, Agent, or Firm* — Ladas & Parry LLP

(57) ABSTRACT

An apparatus for cleaning a gun barrel having striations, which includes a cleaning device that comes in contact with the inner surface of the gun barrel as it is moved by a drive device installed inside a cylindrical main body. The cleaning device includes (i) a plurality of divided plates that fit atop the striations as a saddle and are slanted to correspond to a slope of the striations, (ii) cleaning members fixed to outer peripheries of the respective divided plates that come in contact with the inner surface of the gun barrel, and (iii) a cam device that converts a rotation of a drive motor installed inside the main body into a rectilinear movement in order to move the respective divided plates upward and downward.

16 Claims, 6 Drawing Sheets

AUTOMATIC STRIATED GUN BARREL CLEANER

CROSS-REFERENCE TO RELATED APPLICATION

This application is based on and claims priority from Korean Patent Application No. 10-2007-15924, filed on Feb. 15, 2007 in the Korean Intellectual Property Office, the disclosure of which is incorporated herein in its entirety by reference.

BACKGROUND OF THE INVENTION

1. Field of the Invention

The present invention relates to an apparatus for cleaning a gun barrel having striations, and more particularly, to an apparatus for cleaning a gun barrel having striations that can uniformly clean an inner surface of the gun barrel by moving divided plates, which come in contact with the inner surface of the gun barrel. The apparatus moves forward/backward in the gun barrel using a cam device.

2. Description of the Prior Art

After a shell is fired, alien substances produced due to the combustion of gun powder and ammunition are adhered to the inner surface of the gun barrel, and this lowers the accuracy of the shell being fired. Accordingly, after the gun barrel is used, the alien substances stuck on the inside of the gun barrel are removed and anti-corrosive oil is sprayed.

Typically, firearms having large-sized gun barrels such as self-propelled artilleries and towed howitzers are limited in disassembly, cleaning, and lubrication when they are repaired and maintained, as compared with common rifles which are individual carrying firearms.

In particular, the cleaning and washing of an inner surface of a gun barrel is performed in a manner that a brush is fixed to an end part of a connection rod, and the repetitive pushing/pulling operation of the connection rod into/from the gun barrel removes alien substances remained in the gun barrel after firing. This cleaning process requires lots of labor and physical strength, and many hours.

In order to solve the above problems, Korean Patent Application No. 10-2005-0039179, Korean Patent No. 10-0377487, and Korean Patent Application No. 10-2006-0033030, which are entitled "Apparatus for automatically cleaning a gun barrel" have been proposed by the applicant.

FIGS. 1 and 2 are cross-sectional views of conventional apparatuses for automatically cleaning a gun barrel.

As illustrated in FIG. 1, one conventional apparatus for automatically cleaning a gun barrel includes a drive unit 20, a cleaning unit 30 and a spray unit 40 which are installed between drive motors 20*a* and 20*b*. Another conventional apparatus for automatically cleaning a gun barrel as illustrated in FIG. 2 includes a gear housing 100, a main shaft 200, a sun gear 300, planet gears 300, and an external gear 500.

These conventional cleaning apparatuses use a method of cleaning an inner surface of the gun barrel whereby the cleaning apparatus rotates or moves cleaning members provided thereon forward/backward as it enters along the inner surface of the gun barrel using the drive motors.

However, the above-described cleaning apparatuses have the drawbacks in that they are not effective in cleaning the inner surface of the gun barrel having striations formed on the inner surface of the gun barrel to give a rotating force to the fired shell.

For an improvement on the above-described cleaning apparatuses, Korean Patent Application No. 10-2006-0098356 "Method of cleaning an inner surface of a gun barrel" has been proposed by the applicant. According to this method, cleaning members are arranged to correspond to directions of striations and are fixed to divided plates.

The above-described cleaning method, however, has the problems that an effective cleaning cannot be performed due to the striations formed on the inner surface of the gun barrel, and the movement of the cleaning apparatus becomes intermittent due to friction occurring as the cleaning members come in contact with the inner surface of the gun barrel during the cleaning.

In addition, the above-described conventional cleaning apparatuses and methods have no means for checking the state of the inner surface of the gun barrel after the gun barrel is cleaned, and this causes an ineffective cleaning.

SUMMARY OF THE INVENTION

Accordingly, the present invention has been made to solve the above-mentioned problems occurring in the prior art while advantages achieved by the prior art are maintained intact.

One object of the present invention is to provide an apparatus for cleaning a gun barrel having striations that can uniformly clean an inner surface of the gun barrel by providing cleaning members, the number of which is equal to the number of the striations, in contact with the inner surface of the gun barrel.

Another object of the present invention is to provide an apparatus for cleaning a gun barrel that facilitates an examination of the state of the inner surface of the gun barrel.

Still another object of the present invention is to provide an apparatus for cleaning a gun barrel that can perform a smooth cleaning of 155 mm and 105 mm guns.

In order to accomplish these objects, in one aspect of the present invention, there is provided an apparatus for cleaning a gun barrel having striations formed on an inner surface of the gun barrel, including a cleaning means being in contact with the inner surface of the gun barrel as being moved by a drive means installed inside a cylindrical main body, wherein the cleaning means includes a plurality of divided plates dividedly provided inside the gun barrel in the form of a saddle and being slanted to correspond to a slope of the striations; cleaning members fixed to outer peripheries of the respective divided plates and being in contact with the inner surface of the gun barrel; a cam device converting a rotation of a drive motor installed inside the main body into a rectilinear movement in order to move the respective divided plates upward/downward; and a direction changing part coupling the cam device to the divided plates so that the divided plates go and return along the striations formed on the inner surface of the gun barrel, and distributing a frictional force according to forward/backward movement of the divided plates forward/backward.

The cleaning members may be coupled to insertion grooves of the divided plates formed on positions corresponding to positions of the striations.

The insertion grooves may be formed in zigzag in upper and lower parts of the divided plates.

The cam device may include a rotating plate rotating perpendicular to a length direction of the gun barrel by the drive motor mounted inside the main body; a cam groove having continuous top dead points and bottom dead points and formed on an outer periphery of the rotating plate; and a rectilinear moving shaft coupled to the cam groove to move forward/backward as the rotating plate is rotated.

The direction changing part may include a rectilinear moving shaft configured to move upward/downward by the cam device; an insertion groove formed at an end part of the rectilinear moving shaft; and a connection shaft having one end part on which a fastening ball is formed and the other end part fixed to the divided plate.

The apparatus according to embodiments of the present invention may further include an image capturing means formed on an end part of the cylindrical main body to directly capture an image of the inner surface of the gun barrel.

The respective divided plate goes and returns along the respective guide groove formed on an outer periphery of an inner shaft positioned in the center of the main body, and the guide groove is slanted at an angle corresponding to the respective striation formed on the inner surface of the gun barrel.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

The construction and operation of an apparatus for cleaning a gun barrel according to embodiments of the present invention will now be described in detail with reference to the accompanying drawings.

Figure 1:
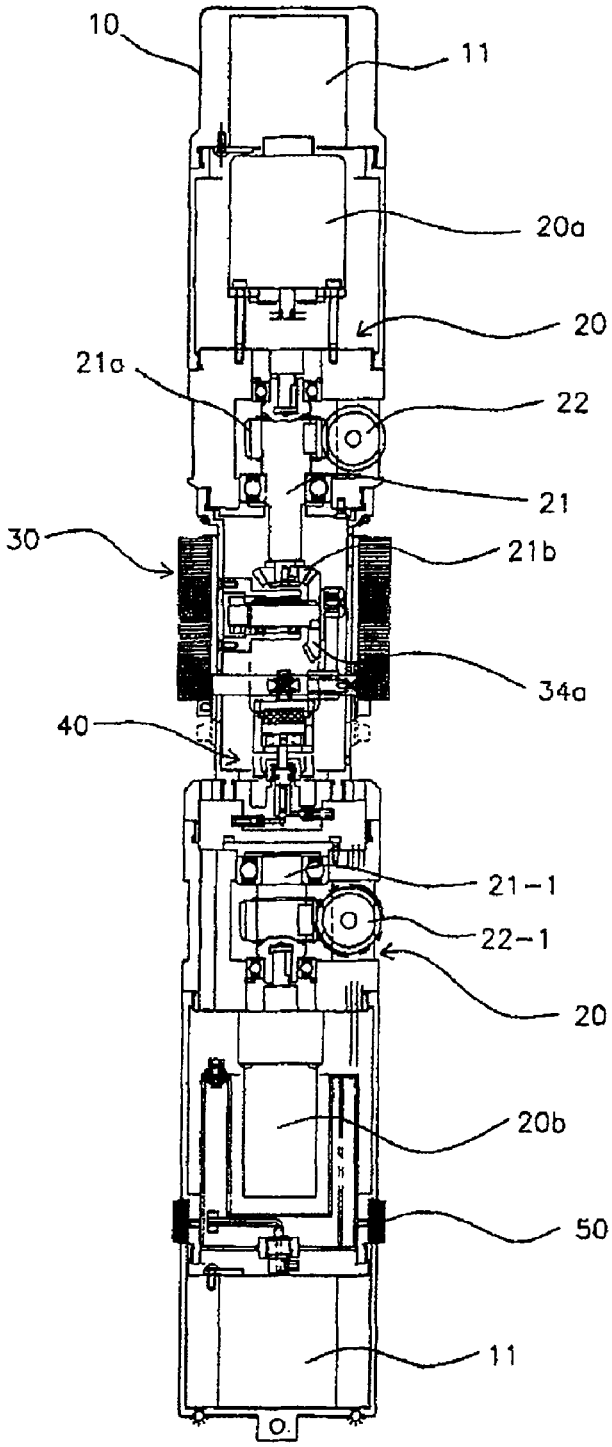
Fig. 1 Prior Art
FIGS. 1 and 2 are cross-sectional views of conventional apparatuses for automatically cleaning a gun barrel.
Figure 2:
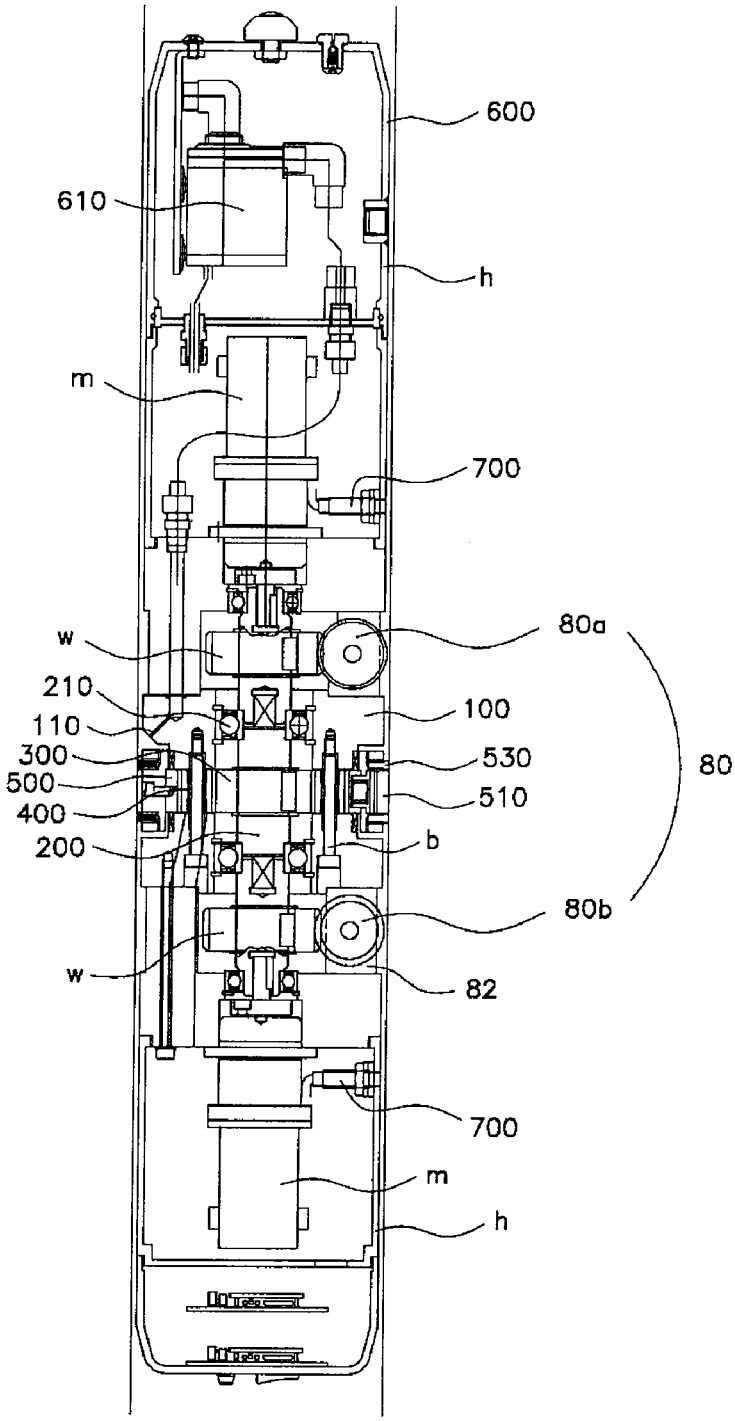
Fig. 2 Prior Art
Figure 3:
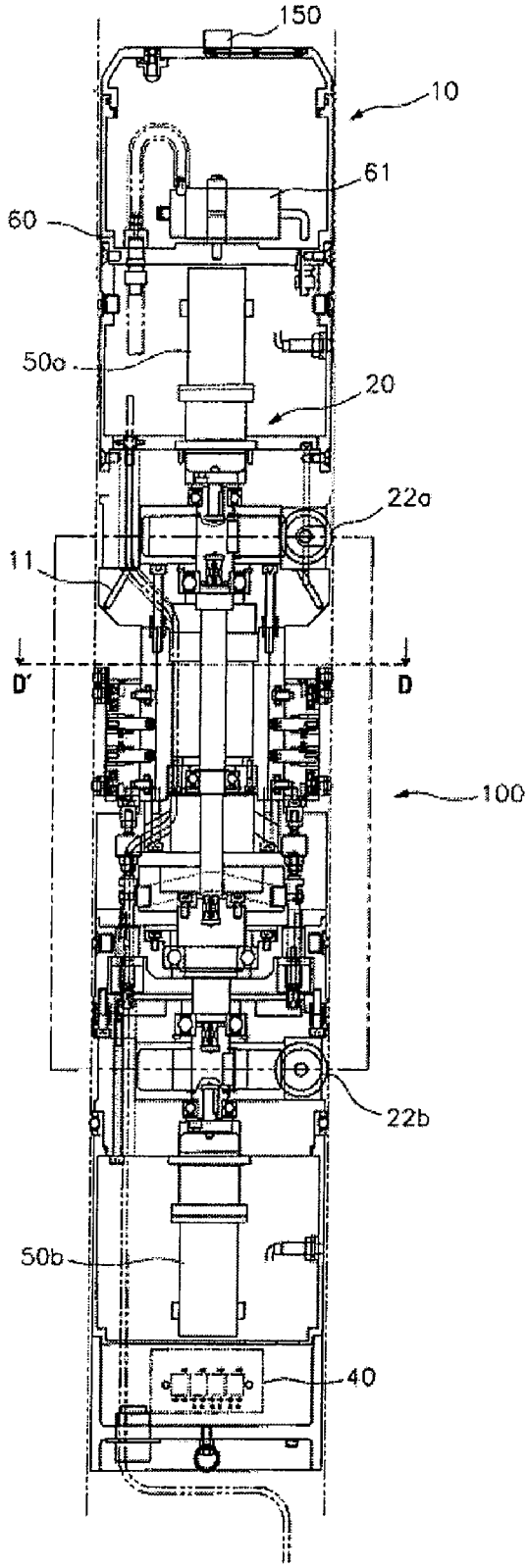
FIG. 3 is a cross-sectional view of an apparatus for cleaning a gun barrel according to an embodiment of the present invention.
Figure 4:
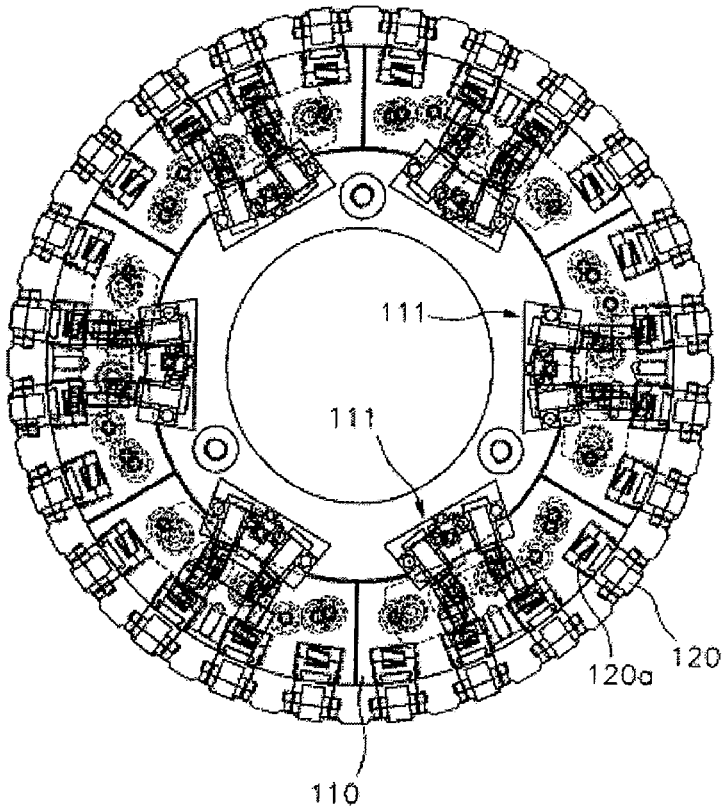
FIG. 4 is a cross-sectional view of a main part of the apparatus taken along the line D-D' of FIG. 3.
Figure 5:
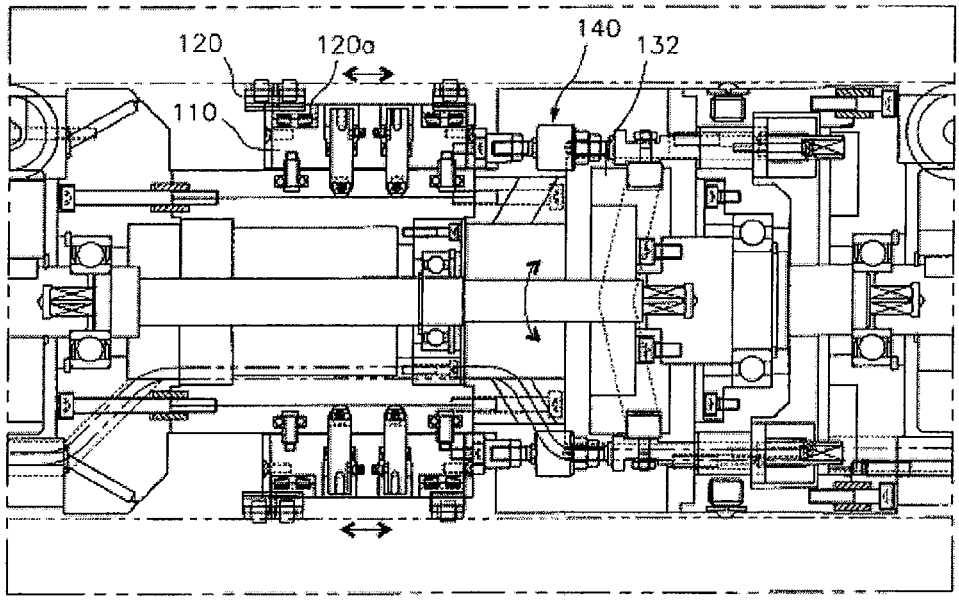
FIG. 5 is an enlarged cross-sectional view of a part indicated by a dotted line of FIG. 3.
Figure 6:
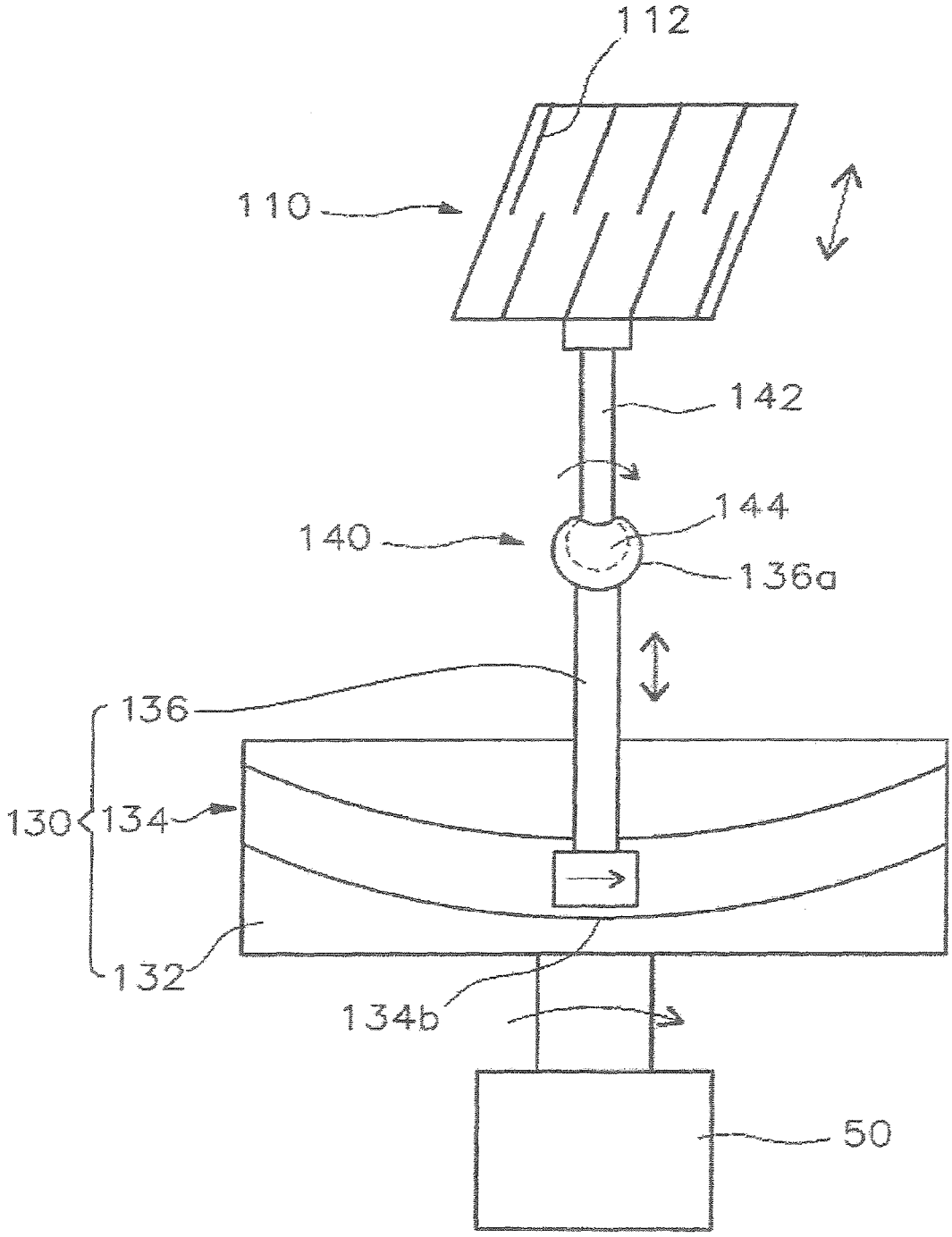
FIG. 6 is a conceptual view illustrating coupling relations of main parts of the present invention.

FIG. 3 is a cross-sectional view of an apparatus for cleaning a gun barrel according to an embodiment of the present invention. FIG. 4 is a cross-sectional view of a main part of the apparatus taken along the line D-D' of FIG. 3, and FIG. 5 is an enlarged cross-sectional view of a part indicated by a dotted line of FIG. 3. FIG. 6 is a conceptual view illustrating coupling relations of main parts of the present invention.

According to the present invention, a cleaning means is coupled to a circular main body 10 having a conventional drive means. The drive means 20 includes wheels 22*a* and 22*b* coupled to drive motors 50*a* and 50*b* to move the circular main body 10 along the inner surface of the gun barrel. To the rear end part of the circular main body, a controller 40 for controlling the cleaning apparatus or an oil tank 60 and an oil pump 61 may be coupled for a smooth cleaning operation.

As illustrated in FIG. 3, the oil tank 60 for storing cleaning solution or anti-corrosive oil is installed in the front part of the main body, and the oil pump 61 sprays the cleaning solution or anti-corrosive oil through a spray orifice 11 formed adjacent to the cleaning means 100 and toward the inner surface of the gun barrel at a specified angle. However, detailed explanation thereof will be omitted.

Next, the cleaning means 100 according to the present invention, as illustrated in FIG. 6, includes the respective divided plate 110, the cleaning member 120, a cam device 130, and a direction changing part 140.

The divided plate 110, as illustrated in FIG. 4, is slanted to correspond to the slope of the striation formed on the inner surface of the gun barrel, and is dividedly provided inside the gun barrel in the form of a saddle. The cleaning member 120 is coupled to an insertion groove 112 formed in the divided plate 110, and serves to clean the inner surface of the gun barrel.

Preferably, the cleaning member 120 is constructed as a block to which a brush or non-woven fabric for cleaning the inner surface of the gun barrel is fixed, and on the lower part of the block, an engaging jaw that is coupled to the insertion groove 112 formed on the outer periphery of the divided plate 110 is formed. In addition, a spring 120*a* for elastically supporting the cleaning member 120 is engaged between the cleaning member 120 and the insertion groove 112 to make the cleaning member always in close contact with the inner surface of the gun barrel.

Also, on the inner surface of the divided plate 110, as illustrated in FIG. 4, one or more support rollers 111 are formed to support load occurring when the cleaning member 120 becomes in contact with the inner surface of the gun barrel.

The insertion groove 112 is formed on the outer periphery of the divided plate 110 to correspond to the position of the striation formed on the inner surface of the gun barrel, and preferably, it is formed in zigzag on the upper/lower parts of the outer surface of the divided plate.

In the case of a general 155 mm gun, since 48 right-inclined striations are formed and six divided plates 110 are provided, 8 insertion grooves are formed in each divided plate. The brush and non-woven fabric are detachably attached to the insertion grooves 112 in order to clean 8 right-inclined striations for each divided plate. In this case, as illustrated in FIG. 6, four insertion grooves 112 are formed in zigzag on each of the upper and lower parts of the divided plate, and thus 8 striations for each divided plate can be cleaned in a narrow space. It is preferable that the insertion groove has a quick changeable structure so that the detachment/attachment of the brush and non-woven fabric is quickly performed.

In addition, the number of divided plates is adjusted depending on the kinds of striations such as striations of a 105 mm gun.

Then, the cam device 130 will be described.

The cam device 130 serves to perform a rectilinear movement of the divided plate 110, and includes a rotating plate 132 rotating perpendicular to the length direction of the gun barrel by the drive motor 50 mounted inside the main body of the apparatus, a cam groove 134 having alternating top dead points 134*a* and bottom dead points 134*b* and formed continuously on an outer periphery of the rotating plate 132, and a rectilinear moving shaft 136 coupled to the cam groove 134 to move forward/backward as the rotating plate 132 is rotated.

The cam groove 134 is formed on the outer periphery of the rotating plate 132, and the number of forward/backward movements per rotation of the rotating plate is determined in accordance with the number of top dead points 134*a* and bottom dead points 134*b*. The rectilinear moving shaft 136 is coupled to the cam groove 134, and performs forward/backward movement, following the cam groove, as the rotating plate 132 rotates.

When the rotating plate 132 is rotated by the drive motor 50 as illustrated in FIG. 6, the rectilinear moving shaft 136 is moved forward/backward along the cam groove.

At this time, since the divided plate requires to be moved forward/backward along the striations at a predetermined angle, the rectilinear moving shaft 136 and the divided plate 110 are rotatably coupled to each other.

The direction changing part 140 is to provide such a rotatable coupling of the rectilinear moving shaft 136 to the divided plate 110, and includes a rectilinear moving shaft 136 being moved upward/downward by the cam device 130, an insertion groove 136*a* formed at an end part of the rectilinear moving shaft 136, and a connection shaft 142 having one end part on which a fastening ball 144 that is engaged with the insertion groove is formed and the other end part fixed to the divided plate 110.

In addition, since the direction changing part 140 couples the divided plate 110 to the cam device 130, the divided plate is moved upward/downward along the striations as the fastening ball coupled to the insertion groove is rotated according to the upward/downward movement of the rectilinear moving shaft 136. For this, a conventional floating joint is used. The direction changing part 140 can be replaced by a means for converting the movement of the rectilinear moving shaft into a predetermined angle such as a flexible coupling.

The respective divided plate goes and returns along the respective guide groove formed on the outer periphery of an inner shaft positioned in the center of the cylindrical main body, and the guide groove is slanted at an angle corresponding to the striations formed on the inner surface of the gun barrel.

The guide groove serves to guide the movement of the divided plate. A shaft having the same structure as the slope of the striations of the gun barrel is provided at the outer diameter of the inner shaft so as to move the rectilinear moving shaft coupled to the divided plate forward/backward according to the slope of the striations, and based on this shaft, the cylindrical outer cam that moves the outer divided plate forward/backward is coupled thereto.

Last, the image capturing means 150 for inspection is coupled to the upper end part of the cylindrical main body 10, and serves to directly capture an image of the inner surface of the gun barrel using a general camera. Accordingly, during the cleaning work, the state of the inner surface of the gun barrel can be confirmed through a monitor connected to an outside.

Hereinafter, the detailed operation and use specifications of the apparatus according to the present invention will be described.

First, a user inserts the apparatus for cleaning a gun barrel according to the present invention into the gun barrel, and moves the apparatus to the inside of the gun barrel by driving the drive means including a drive motor. Here, in front of the circular main body, guide projections are formed and arranged on the striations formed in the inner surface of the gun barrel, and serves to guide the cleaning apparatus along the striations.

Next, as the cleaning apparatus is moved to the inside of the gun barrel, the cleaning means is operated to move the divided plates forward/backward along the striations at a specified angle.

That is, as the rotating plate is rotated by the drive motor, the rectilinear moving shaft coupled to the respective divided plates is move forward/backward, and the respective divided plates are moved forward/backward along the guide groove formed on the inner shaft at the same angle as that of the striations.

In this case, any mismatched angle is corrected by the direction changing part for associating the rectilinear movement of the vertical moving shaft with the forward/backward movement of the divided plates, and the cleaning work is performed as the cleaning members coupled to the divided plates become in close contact with the inner surface of the gun barrel.

Accordingly, unlike the conventional cleaning means, the frictional force occurring when the cleaning members become in contact with the inner surface of the gun barrel is distributed forward/backward as the respective divided plates are moved forward/backward along the cam groove formed on the rotating plate, and thus the frictional force less affects the speed of the cleaning apparatus in a traveling direction of the cleaning apparatus.

Here, it is preferable that the drive motor of the drive means is used as the drive motor of the cleaning means, and the period of the cam groove formed on the divided plates is set to properly determine the number of repetitions per rotation of the divided plate.

During the cleaning process, the state of the inner surface of the gun barrel is observed using the image capturing means fixed to the front side of the cylindrical main body to improve the cleaning effect.

As described above, the cleaning apparatus according to the present invention performs a cleaning work in a manner that cleaning members are coupled to the divided plates, which are dividedly provided inside the gun barrel in the form of a saddle and are slanted to correspond to the slope of the striations formed on the inner surface of the gun barrel, and the cleaning members become in uniform contact with the inner surface of the gun barrier by moving the divided plates forward/backward using the cam device.

In addition, an image capturing means for observing the state of the inner surface of the gun barrel is coupled to the end part of the gun barrel to improve the efficiency of the cleaning work.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An automatic striated gun barrel cleaner, including a cleaning means being in contact with the inner surface of a striated gun barrel as being moved by a drive means installed inside a cylindrical main body, wherein the cleaning means comprises:

a plurality of divided plates dividedly provided in the form of a saddle and being slanted to correspond to a slope of the striations of the striated gun barrel;

cleaning members fixed to outer peripheries of the respective divided plates and being in contact with the inner surface of the gun barrel;

a cam device converting a rotation of a drive motor installed inside the main body into a rectilinear movement in order to move the respective divided plates upward/downward; and a direction changing part coupling the cam device to the divided plates so that the divided plates go and return along the striations formed on the inner surface of the gun barrel, and distributing a frictional force according to forward/backward movement of the divided plates forward/backward.

2. The automatic striated gun barrel cleaner of claim 1, wherein the cleaning members are coupled to insertion grooves of the divided plates formed on positions corresponding to positions of the striations.

3. The automatic striated gun barrel cleaner of claim 2, wherein the insertion grooves are formed in zigzag in upper and lower parts of the divided plates.

4. The automatic striated gun barrel cleaner of claim 2, wherein a spring for elastically supporting the cleaning member is engaged between the cleaning member and the insertion groove to make the cleaning member always in close contact with the inner surface of the gun barrel.

5. The automatic striated gun barrel cleaner of claim 1, wherein the cam device comprises:

a rotating plate rotating perpendicular to a length direction of the gun barrel by the drive motor mounted inside the main body;

a cam groove having alternating top dead points and bottom dead points and formed continuously on an outer periphery of the rotating plate; and a rectilinear moving shaft coupled to the cam groove to move forward/backward as the rotating plate is rotated.

6. The automatic striated gun barrel cleaner of claim 1, wherein the direction changing part comprises:

a rectilinear moving shaft configured to move upward/downward by the cam device;

an insertion groove formed at an end part of the rectilinear moving shaft; and a connection shaft having one end part on which a fastening ball is formed and the other end part fixed to the divided plate.

7. The automatic striated gun barrel cleaner of claim 1, further comprising an image capturing means formed on an end part of the cylindrical main body to directly capture an image of the inner surface of the gun barrel.

8. The automatic striated gun barrel cleaner of claim 1, wherein the respective divided plate goes and returns along the respective guide groove formed on an outer periphery of an inner shaft positioned in the center of the main body, and the guide groove is slanted at an angle corresponding to the respective striation formed on the inner surface of the gun barrel.

9. An apparatus for cleaning a gun barrel having a plurality of striations formed on an inner surface of the gun barrel, the apparatus comprising a cylindrical main body, a drive motor disposed inside the main body, cleaning means for contacting the inner surface of the gun barrel, and drive means disposed inside the cylindrical main body for moving the cleaning means, wherein the cleaning means comprises:

a plurality of divided plates comprising means for fitting the divided plates atop the plurality of striations as a saddle, said means being slanted to correspond to a slope of the striations;

cleaning members fixed to outer peripheries of the respective divided plates such that the cleaning members are in contact with the inner surface of the gun barrel when the divided plates are fit atop the striations;

cam means for converting a rotation of the drive motor disposed inside the main body into a rectilinear movement in order to move the respective divided plates upward and downward; and direction changing means for coupling the cam means to the divided plates so that the divided plates can move along the striations formed on the inner surface of the gun barrel and a frictional force occurring when the cleaning members contact the inner surface of the gun barrel can be distributed forward and backward according to forward and backward movement of the divided plates.

10. The apparatus of claim 9, wherein the cleaning members are coupled to insertion grooves of the divided plates, said grooves being disposed on the divided plates so that they can align with positions of the striations on the gun barrel.

11. The apparatus of claim 10, wherein the insertion grooves are in a zigzag disposition in upper and lower parts of the divided plates.

12. The apparatus of claim 10, comprising spring means for elastically supporting the cleaning members and for insuring close contact between the cleaning members and the inner surface of the gun barrel when the apparatus is inserted into the gun barrel with the divided plates fit atop the striations.

13. The apparatus of claim 9, wherein the cam means comprises:

a rotating plate that rotates perpendicular to a longitudinal direction of the gun barrel;

a cam groove formed on an outer periphery of the rotating plate; and a rectilinear moving shaft coupled to the cam groove that moves forward and backward as the rotating plate is rotated.

14. The apparatus of claim 9, wherein the direction changing means comprises:

a rectilinear moving shaft that is movable upward and downward by the cam device;

an insertion groove formed at an end part of the rectilinear moving shaft; and a connection shaft having one end part on which a fastening ball is formed and another end part fixed to one of the plurality of divided plates.

15. The apparatus of claim 9, further comprising image capturing means formed on an end part of the cylindrical main body for directly capturing an image of the inner surface of the gun barrel.

16. The apparatus of claim 9, wherein the respective divided plates are movable along respective guide grooves formed on an outer periphery of an inner shaft positioned in the center of the main body, and wherein the guide grooves are slanted at an angle corresponding to an angle of the striations formed on the inner surface of the gun barrel.

* * * * *